United States Patent [19]

Mahnke

[11] Patent Number: 4,566,691

[45] Date of Patent: Jan. 28, 1986

[54] EXERCISE BENCH

[75] Inventor: Parker E. Mahnke, Studio City, Calif.

[73] Assignee: Marcy Gymnasium Equipment Co., Alhambra, Calif.

[21] Appl. No.: 550,298

[22] Filed: Nov. 9, 1983

[51] Int. Cl.[4] ..... A63B 13/00

[52] U.S. Cl. ..... 272/123; 272/144; 272/134

[58] Field of Search ..... 272/144, 134, 122, 123, 272/136, 93, 117; 128/33; 297/377; D21/191, 197

[56] References Cited

U.S. PATENT DOCUMENTS

| | | | |
|---|---|---|---|
| D. 262,810 | 1/1982 | Lynn | D21/191 |
| 3,358,679 | 12/1967 | Borrelli | 128/33 |
| 3,625,511 | 12/1971 | Rennemann | 272/122 |
| 3,874,658 | 4/1975 | Flowers | 272/144 |
| 4,205,838 | 6/1980 | McIntosh | 272/123 |
| 4,411,425 | 10/1983 | Milnar | 272/123 |

FOREIGN PATENT DOCUMENTS

| | | | |
|---|---|---|---|
| 2076299 | 12/1981 | United Kingdom | 272/144 |

*Primary Examiner*—Richard J. Apley

*Assistant Examiner*—Robert W. Bahr

*Attorney, Agent, or Firm*—James E. Brunton

[57] ABSTRACT

An exercise bench for use by a trainee in the performance of free weight exercises using a barbell type apparatus including an elongate bar with weights carried on either end thereof. The bench includes a first frame assemblage having a pair of spaced apart upstanding members, including cradle-like supports for supporting the elongate bar of the barbell apparatus and a second frame assemblage. The second frame assemblage includes a seat portion and back portion, a part of the seat portion being uniquely disposed forwardly of the plane of said upstanding members and a part being disposed rearwardly thereof. The back portion is also rearwardly spaced apart from the plane of the upstanding members so that, with the barbell apparatus being supported on said support cradles, the trainee can sit on said seat portion facing the elongate bar of the apparatus and lean against the back portion with his upper torso positioned between the elongate bar and the back portion. In this way the trainee has positive control over the free weights at all times and, upon completion of the lifting exercise, can easily and safely replace the weights on the conveniently located supporting cradles during the last downward movement of the weights.

12 Claims, 8 Drawing Figures

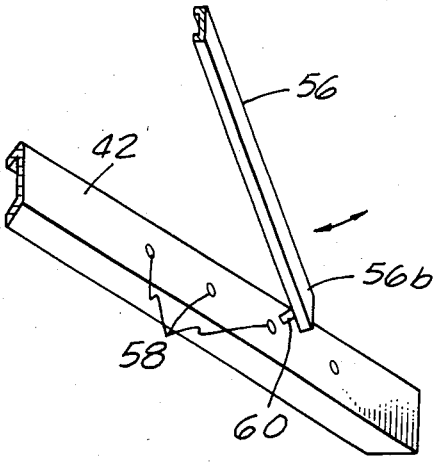
FIG. 3.
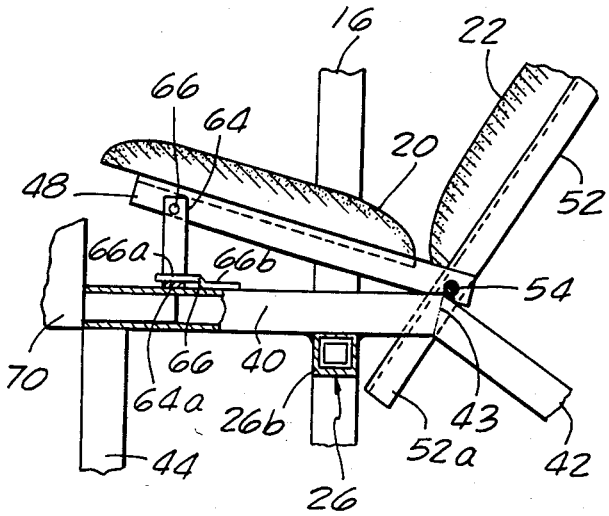
FIG. 4.
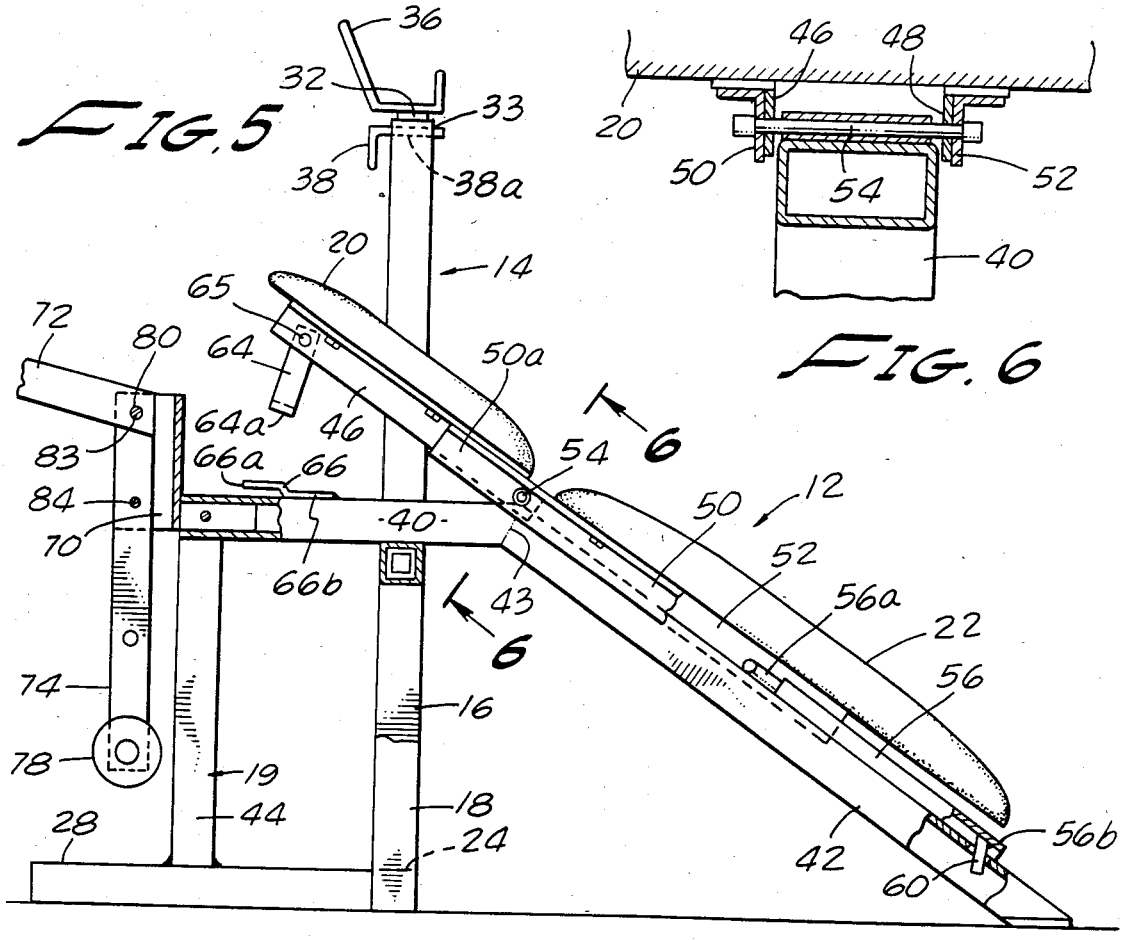
FIG. 5
FIG. 6

EXERCISE BENCH

BACKGROUND OF THE INVENTION

1. Field of the Invention

The present invention relates generally to body exercising equipment and more particularly to an exercise bench of the type used in the performance of free weight or barbell type exercises.

2. Discussion of the Prior Art

Various types of exercise benches have been manufactured in the past. Common to these types of devices is a pair of spaced apart vertical standards including cradle-like supports adapted to support the free weights when they are not in use and an interconnected supporting frame designed to support a planar bench upon which the trainee positions himself while lifting the weights from the supporting standards.

In lifting the weights, the trainee normally lies on his back on the bench so that his upper body is positioned between the vertical standards and below the weights at rest thereon. In this position the trainee lifts the weights from the cradle and then commences the exercise cycle which consists of raising and lowering the weights by alternately bending and straightening the arms.

In some prior art devices the bench is designed so that the forward position thereof may be raised to a sloping position relative to the supporting frame. However, when the bench is in this position the trainee safely lift the weights while leaning his back against the elevated portion because his shoulders and arms are positioned too far forwardly of the supporting standards.

Another substantial drawback of the design of prior art benches of the class described resides in the fact that when the trainee is lying on his back lifting the weights, the cradle supports which support the weights are located substantially above him. This means that after the last lifting cycle the trainee must make one final exertion to lift the weights and replace them within the support cradles. Typically, after the last lifting cycle the trainee is very fatigued and may have difficulty in replacing the weights on the supporting cradles. At this point the trainee is highly susceptible to serious injury caused by dropping the weights on his head or upper body while trying to replace them on the support cradle.

The novel bench of the present invention uniquely overcomes the drawbacks of the prior art exercising benches by providing a bench which permits the trainee to face the weights while in a seated position with his upper body being positioned between the weights and the seat back. This enables the trainee to maintain complete control of the weights at all times and to safely replace the weights within the supporting cradles on the final exercise cycle as the weights are being lowered. Since the trainee is facing the weight supporting standards in a seated position, the supporting cradles are located at a height which is convenient for replacing the weights during the downward movement of the weights. Accordingly, risk of dropping the weights at the end of the exercise program is considerably reduced and injury to the trainee is substantially avoided.

SUMMARY OF THE INVENTION

It is an object of the present invention to provide a novel exercise bench having a pivotally adjustable seat and back portions adapted for use by a trainee in the performance of a large number of exercises including the free weight type exercises using an elongate bar with weights carried on either end thereof in which the trainee can position himself on the bench in a seated incline position with his back supported by the seat back while facing the weights and also facing a pair of spaced upright support standards which are adapted to support the elongate bar when the weights are at rest. With this unique construction the trainee can safely and conveniently lift the weights from the support standards at the beginning of the lifting exercises and then safely replace them on the standards at the completion of the exercise with a minimum likelihood of dropping the weights due to fatigue.

It is another object of the invention to provide an exercise bench of the aforementioned character in which the seat and back portions are individually adjustable and also can be moved into a co-planar, horizontal or inclined position to enable the performance of various exercises including decline and supine pressing of the weights. In this regard, it is a particular feature of the invention that when the back portion is moved to its lower most position the seat portion will automatically be raised into a co-planar relationship with the back portion so that the trainee can lie flat on the exercise bench either in the back or on the stomach.

It is another object of the invention to provide an exercise bench as described in the preceding paragraphs which includes leg exercising apparatus pivotally carried at one end of the bench to enable the performance of several leg development exercises including prone leg curls and seated leg extensions.

Another object of the invention is to provide an exercise bench of the character described in the foregoing paragraphs in which the leg exercising mechanism can be locked against pivotal movement to enable the performance of sit ups and similar body building exercises.

Still another object of the invention is to provide an exercise bench of the class described in which the spacing between the weight supports can be quickly and easily adjusted and in which the height of the weight supports can also readily be adjusted.

Yet another object of the invention is to provide an exercise bench of the type disclosed which is of rugged construction, is highly stable in use, and is fully adjustable to permit the accomplishment of numerous types of exercises.

These and other objects of the invention are satisfied by the exercise bench for use by a trainee in the performance of various exercises including free weight type exercise using an elongate bar with weights carried on either end thereof, and which comprises a first frame assemblage having a pair of spaced apart upstanding members, including support members for supporting the elongate bar of the free weight; a second frame assemblage cooperatively associated with the first frame assemblage including pivotally adjustable seat and back portions, at least a portion of the seat portion being disposed between the upstanding members and the back portion being spaced apart therefrom, whereby the trainee can sit on the seat portion facing the elongate bar of the free weight with his upper torso positioned between the elongate bar and the back portion; and a leg exercising mechanism pivotally connected to the second frame assemblage.

BRIEF DESCRIPTION OF THE DRAWINGS

FIG. 3 is an enlarged, fragmentary perspective view showing the construction of the adjustment means of the invention which permits adjustment of the back support member of the bench.

FIG. 4 is an enlarged, fragmentary side elevational view, partly in cross-section illustrating in greater detail the mechanisms for pivotally adjusting the seat and back support members of the Exercise Bench.

FIG. 5 is a side elevational, partly sectional view similar to FIG. 4, but showing the seat and back of the Exercise Bench adjusted into an inclined, substantially co-planar configuration.

FIG. 6 is a cross-sectional view taken along lines 6—6 of FIG. 5 showing the pivotal interconnection of the seat and back support.

DESCRIPTION OF THE EMBODIMENTS OF THE INVENTION

Figure 1:
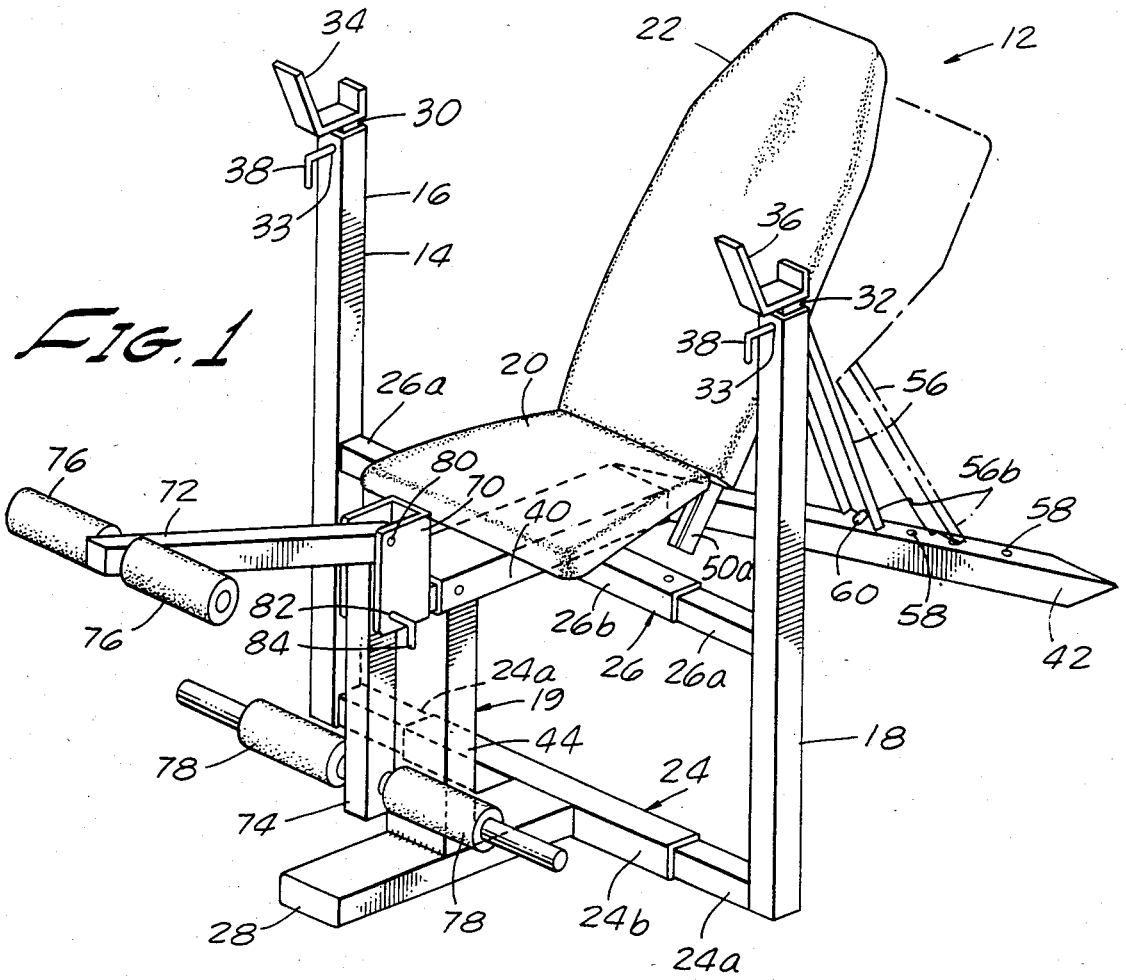
FIG. 1 is a generally perspective view of one form of the Exercise Bench of the present invention.
Figure 2:
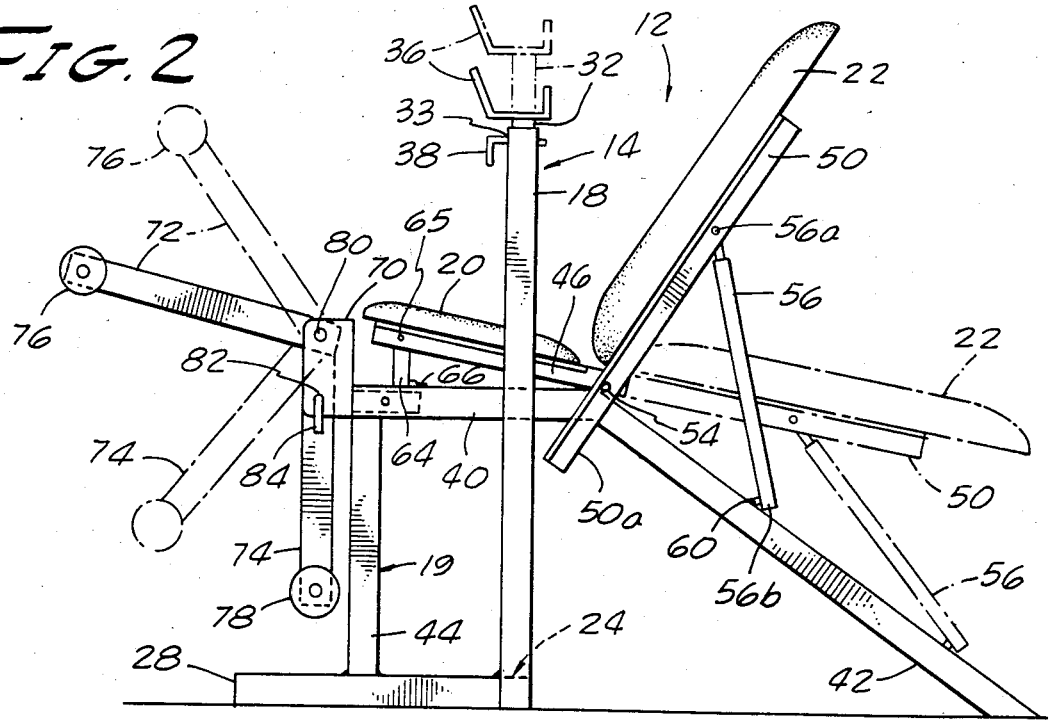
FIG. 2 is a side elevational view of the Exercise Bench shown in FIG. 1. The phantom lines in FIG. 2 illustrate the adjustability of the back support, vertical uprights and leg exercising apparatus of the device.

Referring to the drawings, and particularly to FIGS. 1 and 2, one form of the Exercise Bench of the present invention, generally designated by the numeral 12, is adapted for use by a trainee in the performance of exercises including free weight exercises using a barbell-type apparatus having an elongated bar with weights carried on either end thereof. Bench 12 comprises a first frame assemblage 14 having a pair of spaced apart, tubular upstanding members 16 and 18 which adjustably carry support means for supporting the elongate bar of the barbell apparatus at various heights above the floor.

A second frame assemblage 19 is cooperatively associated with first frame assemblage 14 and includes a seat portion 20 and a back support portion 22. As best seen by referring to FIG. 2, at least a portion of seat 20 is disposed forwardly of the substantially vertically extending plane containing upstanding members 16 and 18 and a portion is disposed rearwardly thereof. The back support 22 is rearwardly spaced from the plane of upstanding members 16 and 18, whereby, with the elongate bar of the barbell apparatus supported on the support means, the trainee can sit on the seat portion 20 facing the elongate bar and lean back against back portion 22. In this seated incline, free weight exercising position the trainee's upper torso is strategically positioned between the elongate bar and the back support 22. This enables the trainee to safely lift the weights from the support means, perform the prescribed number of lifting cycles, and then safely replace the barbell apparatus on the support means during the downward movement of the last lifting cycle. Since during the lifting cycle the trainee is at all times facing the barbell apparatus and the raised weight support means complete control of the apparatus can be maintained even though the trainee experiences substantial fatigue during the last lifting cycle. This type of exercise cannot be performed on the typical prior art exercise bench illustrated in FIG. 8.

First frame assemblage 14 of the bench of the present invention also includes a base member assemblage 24 which interconnects members 16 and 18 proximate their lower end, and a cross-member assemblage 26 which interconnects members 16 and 18 at locations intermediate their ends. As indicated in FIG. 1, assemblages 24 and 26 comprise respectively pairs of rigid side members **24*a* and 26*a*, which members are fixedly connected at their outboard ends to members 16 and 18, and hollow central members 24*b* and 26*b* which are adapted to telescopically receive the inner, free ends of members 24*a* and 26*a*. With this arrangement, the spacing between upstanding members 16 and 18 can readily be adjusted to accommodate barbells of various lengths. This arrangement also permits the upstanding members 16 and 18 to be widely separated for increased stability when heavy weights are being used by the trainee. Also forming a part of first frame assemblage 14, and functioning to provide further stability to the exercise bench, is a forwardly extending base member 28 which is rigidly connected to member 24*b* of cross-member assemblage 24**.

As illustrated in FIG. 2, the support means of this embodiment of the invention comprises members 30 and 32 which are telescopically receivable within hollow upstanding members 16 and 18 respectively. Provided at the upper end of members 30 and 32 are cradle-like portions 34 and 36 which are adapted to safely support the elongate bar of the barbell apparatus when the barbell apparatus is at rest. To permit adjustability of the support means, members 16 and 18 are apertured, or drilled through, proximate their upper ends at 33. Additionally, members 30 and 32 are provided with a plurality of spaced apart apertures along their length. The apertures in members 16, 18, 30 and 32 are adapted to closely receive the shank portion of "L" shaped locking pins 38 which may be inserted from either the front or rear of members 16 and 18. As best seen by referring to FIG. 5, the shank portion **38*a* of locking pins 38 are of a length sufficient to extend through the apertures formed in members 16, 18, 30 and 32** so as to lock the support means at selected vertically heights with respect to the floor.

Referring once again to FIG. 1, second frame assemblage 19 further comprises a rigid member 40 which extends transversely of cross-member 26 and an angularly downwardly depending member 42 which engages the floor at one end and is interconnected with member 40 at its opposite end. To provide added rigidity to the bench, a vertical member 44 interconnects the lower surface of member 40 with the upper surface of base member 28.

Turning now to FIGS. 4 and 6, seat 20 is provided with a pair of transversely spaced apart right-angle support members 46 and 48 which are securely affixed to the lower surface of the upper padded portion of the seat. Similarly, back 22 includes a pair of spaced apart right-angle support members 50 and 52 which are securely affixed to the bottom of the padded portion of the back 22. As best seen in FIG. 6, member 50 nests within member 46, member 52 nests within member 48 and each of the members is apertured to receive the ends of a pivot pin 54 the central portion of which is affixed to members 40 and 42 proximate the junction 43 thereof. With this construction, seat 20 and back 22 are pivotally movable relative to one another with seat 20 being pivotally movable relative to member 40 and back 22 being pivotally movable relative to member 42.

As can be seen by referring to FIGS. 2 and 5, angle brackets 50 and 52 include downwardly depending portions 50*a* and 52*a* which are adapted to engage angle members 46 and 48 when back 22 is pivotally moved downwardly toward member 42. With this construction, when back 22 is lowered to the position shown by the phantom lines in FIG. 2, extensions 50*a* and 52*a* of the back portion will engage members 46 and 48 of the seat 22 causing the seat 20 to move pivotally relative to pivot pin 54 into a substantially co-planar relationship with back 22. As indicated in FIG. 5, this co-planar relationship will be maintained until back portion 22 is inclined to the maximum extent shown in FIG. 5.

To permit adjustment of back support 22 into a plurality of inclined positions between a first substantially vertically extending position to the second fully inclined position shown in FIG. 5, adjustment means are provided. In the form of the invention shown in FIG. 3, these means comprise an elongate brace member 56 having one end 56*a* pivotally connected to back portion 22 and the other end 56*b* adapted to be removably interconnected with angularly downwardly depending member 42 at a plurality of locations along its length. For this purpose, member 42 is provided with a plurality of spaced apart apertures 58 along its length. These apertures are adapted to receive a short stud element 60 affixed to lower end 56*b* of adjustment member 56 and extending perpendicularly therefrom. With this arrangement, adjustment of the back support is accomplished by first lifting member 56 in the manner shown in FIG. 3, to a position where stud 60 is clear of apertures 58. The back support 22 can then be pivoted about pivot pin 54 to the desired inclined position. Stud 60 is then reinserted into nearest aperture 58 whereby the back support will be positively and securely supported in the desired inclined orientation.

So that the seat and back of the exercise bench can be securely locked in the co-planar inclined position indicated by the phantom lines in FIG. 2, locking means are provided proximate the forward end of seat 20. As best seen by referring to FIG. 5, in this embodiment of the invention, the locking means of the invention is provided in the form of a downwardly depending, substantially "U" shaped bracket 64 which is adapted to pivot about a pivot pin 66 carried between angle members 46 and 48 of seat 20. The bight portion 64*a* of "U" shaped member 64 is adapted to be closely received beneath the upstanding forward portion 66*a* of a locking bracket 66 the rear portion 66*b* of which is fixedly connected to the upper surface of rigid member 40. When bight member 64*a* is received beneath the forward portion 66*a* of member 66 in the manner shown in FIGS. 2 and 4, seat 20 is locked against pivotal movement about pivot pin 54. When the seat 20 is in this locked position, back portion 22 can be pivotally moved downwardly into the orientation shown by the phantom lines in FIG. 2, but cannot be further inclined because member 64 prevents further upward pivotal movement of seat 20 (due to the urging of members 50*a* and 52*a*) beyond the position shown in FIG. 2.

Considering now the leg exercising means of the device of FIGS. 1 through 6, a support bracket 70 is affixed proximate the forward portion of member 40. This bracket, which is "U" shaped in cross-section, is adapted to pivotally carry the leg exercising means shown here as comprising angularly disposed, rigidly interconnected members 72 and 74. Extending transversely from the end portions of members 72 and 74 are padded supports 76 and 78 respectively, which supports are adapted to be engaged by the feet of the trainee. As best seen by referring to FIG. 2, each leg of bracket 70 is provided with vertically spaced apart apertures 80 and 82. Adapted to be received within apertures 80 and to extend through an aperture provided proximate the junction of members 72 and 74, is a pivot pin 83 (FIG. 5). Pin 83 pivotally supports the leg exercising means so that members 72 and 74 can be moved along an arcuate path in the manner indicated by the phantom lines in FIG. 2. The lower aperture 82 provided in bracket 70 is adapted to closely receive a second locking pin 84 (FIG. 1) which extends through aperture 82 and into an aligned aperture provided in member 74. With the locking pin 84 in place, the leg exercise means is locked against pivotal movement and functions to hold the feet of the trainee in position during sit-ups and similar exercises wherein it is desired to lock the legs against forward or upward movement.

Figure 8:
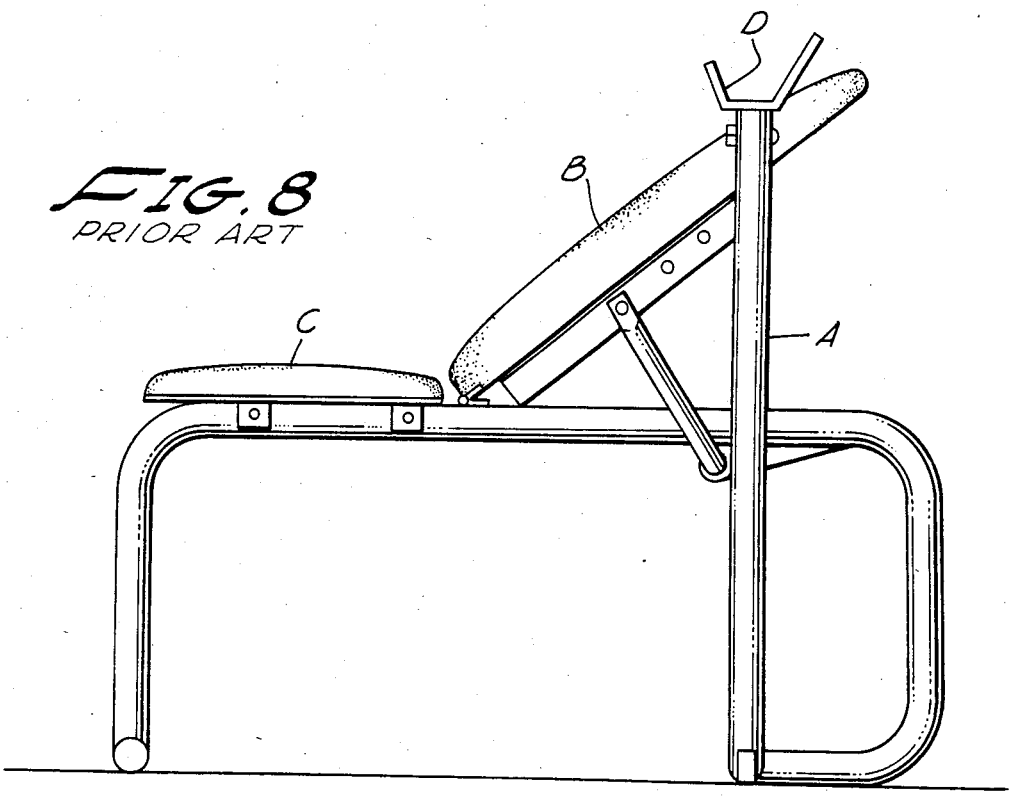
FIG. 8 PRIOR ART
FIG. 8 is a side elevational view of a typical prior art exercise bench.

With the exercise bench of the invention in the configuration shown in FIG. 1, the trainee can safely and conveniently exercise with the weights while in a seated inclined position. The superior safety advantages of the bench for this type of exercise have previously been discussed. Referring to FIG. 8, which illustrates a typical prior art exercise bench, it is at once apparent that this seated incline type exercise cannot safely be performed using standard prior art benches. Because of the relative position of the uprights A, the back support B and the seat C it is obvious that the trainee cannot sit on the seat C, lean against the back B and still lift the weights from the uprights A. In order to lift the weights from the supports A of a prior art bench of the type shown in FIG. 8, the back B must be lowered into a substantially horizontal position so that shoulders of the trainee can be positioned between the upright and below the lifting bar of the weights. Only in this way can the trainee assume a position far enough rearwardly of the uprights A to correctly grasp the lifting bar. Alternatively, if the back B is not lowered, then the uprights A must be appreciably longer so that the trainee can assume a position below the higher positioned weights. However, in either event, when the final exercise cycle is completed, the weights must be lifted upwardly in order to replace them on the support cradles D. It is during this final lifting effort that the trainee is fatigued and in serious jeopardy of injury. The potential for this type of serious injury is uniquely and effectively prevented by the novel exercise bench of the present invention.

Referring to FIG. 2, the seated incline free weight exercise is rendered more convenient by moving the seat 20 into the position thereshown. With the seat in this position the tendency of the trainee's lower body to slide forwardly is substantially lessened thereby making performance of the exercise safer and more comfortable.

With the bench in the configuration shown in either FIG. 1 or FIG. 2, the trainee can also conveniently perform leg lifting type exercises. These exercises are accomplished by the trainee positioning the feet below the pads 78 and then lifting the legs causing movement of members 72 and 74 in the manner illustrated by the phantom lines of FIG. 2.

By moving the back support into the configuration shown in the phantom lines of FIG. 2 and by locking the seat 20 in position using locking member 64, the device can conveniently be used as a bent knee abdominal board and for sit-up type exercises. A decline press can also conveniently be performed with the device in this orientation.

Figure 7:
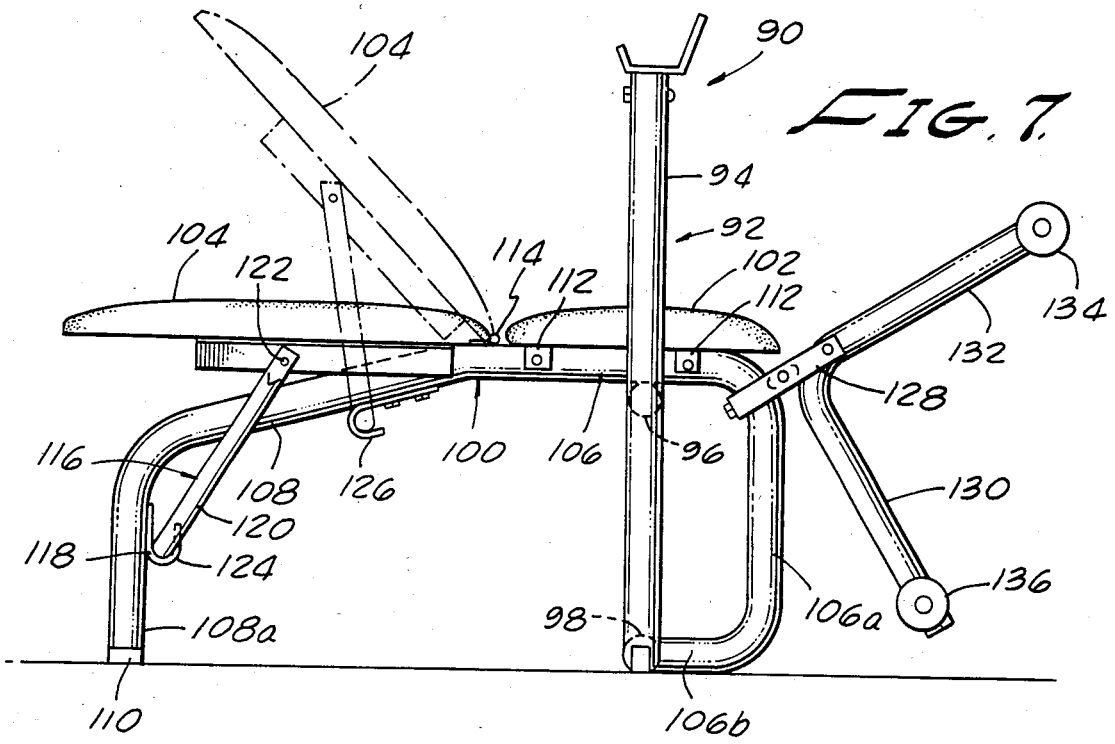
FIG. 7 is a side elevational view of another form of the exercise bench of the invention.

Referring now to FIG. 7, there is shown another form of the Exercise Bench of the present invention, generally designated by the numeral 90. Bench 90, which is of similar construction and operation to previously described bench 12 comprises a first frame assemblage 92 having a pair of spaced apart, tubular upstanding members 94 interconnected by upper and lower rigid cross-members 96 and 98. Members 94 are adapted to adjustably carry support means for supporting the elongate bar of the barbell apparatus at various heights above the floor.

A second frame assemblage 100 is cooperatively associated with first frame assemblage 92 and includes a seat portion 102 and a back support portion 104. At least a portion of seat 102 is disposed forwardly of the substantially vertically extending plane containing upstanding members 94 and a portion is disposed rearwardly thereof. The back support 104 is rearwardly spaced from the plane of upstanding members 94 whereby, with the elongate bar of the barbell apparatus supported on the support means, the trainee can sit on the seat portion 102 facing the elongate bar and lean back against back portion 104. In this seated incline, free weight exercising position the trainee's upper torso is strategically positioned between the elongate bar and the back support 104.

Second frame assemblage 100 further comprises a rigid member 106 which extends transversely of cross-member 96 and an angularly downwardly depending member 108 which engages the floor at one end and is interconnected with member 106 at its opposite end. To provide added rigidity to the bench, member 106 includes a forward portion having a downwardly depending leg **106*a* and floor engaging leg 106*b* which is connected to cross-member 98 intermediate its ends. A floor engaging transverse member 110 is also connected to the downwardly depending leg portion 108*a* of member 108**.

Seat 102 is rigidly fixed to members 106 by brackets 112, while back 104 is pivotally adjustable about a pivot pin 114 affixed to member 106.

To permit adjustment of back support 104 into two inclined positions namely a first position as shown by the phantom lines in FIG. 7 and a second fully inclined position shown by the solid lines in FIG. 7, adjustment means are provided. In the form of the invention here shown, these means comprise a generally U-shaped brace member 116 having a bight portion 118 and a pair of leg portions 120. Leg portions 120 are pivotally connected to back portion 104 by pivot pins 122. Bight portion 118 is receivable within either of two curved support brackets 124 and 126 rigidly affixed to member 108. With this arrangement, adjustment of the back support is accomplished by lifting back 104 from the solid line position shown in FIG. 7 to a position shown by the phantom lines in FIG. 7, and then inserting the bight portion 118 of brace 116 into curved bracket 126. With the brace 116 thusly positioned the back 104 is positively and securely supported in the inclined orientation shown by the phantom lines of FIG. 7.

Considering now the leg exercising means of the device shown in FIG. 7, an angularly upward extending suppport bracket 128 is affixed proximate the forward portion of member 106. This bracket is adapted to pivotally carry the leg exercising means shown here as comprising angularly disposed, rigidly interconnected members 130 and 132. Extending transversely from the end portions of members 130 and 132 are padded supports 134 and 136 respectively, which supports are adapted to be engaged by the feet of the trainee. The operation of the leg exercising means of this form of the invention is substantially the same as previously described in connection with the leg exercise means of bench 12.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. An exercise bench for use by a trainee in the performance of free weight exercises using a barbell type apparatus having an elongate bar with weights carried on either end thereof, comprising:

(a) a first frame assemblage having a pair of spaced apart upstanding members, including support means for supporting the elongate bar of the bar bell apparatus;

(b) a second frame assemblage cooperatively associated with said first frame assemblage including a seat portion and an inclined back portion, a substantial portion of said seat portion being disposed forwardly of the plane of said upstanding members and a portion being disposed rearwardly thereof and said back portion being spaced apart therefrom, whereby with the barbell apparatus being supported on said support means the trainee can sit on said seat portion facing the elongate bar of the apparatus and engage said back portion with his back, his upper torso being positioned between the elongate bar and said back portion.

2. An exercise bench as defined in claim 1 in which said back portion is pivotally movable relative to said seat portion.

3. An exercise bench as defined in claim 2 in which said back portion is pivotally movable from a first position wherein said back portion extends at an angle relative to said seat portion to a second position wherein said back portion is substantially co-planar with said seat portion.

4. An exercise bench as defined in claim 2 in which said second frame assemblage includes an elongate seat support member disposed intermediate said upstanding members of said first frame assemblage and in which said seat portion is pivotally movable relative to said seat support member from a first substantially horizontal position to a second inclined position.

5. An exercise bench as defined in claim 4 in which said second frame assemblage includes a back support member connected to said seat support member and depending angularly downwardly therefrom.

6. An exercise bench as defined in claim 4 in which said upstanding members of said first frame assemblage are adjustably movable toward and away from said seat support member.

7. An exercise bench as defined in claim 4 including leg exercising means pivotally connected to said seat support member, said means including portions engageable by the feet of the trainee when the trainee is seated on said seat whereby an upward extension of the legs by the trainee will impart pivotal movement to said leg exercising means.

8. An exercise bench for use by a trainee in the performance of exercises, including free weight exercises, using an elongate bar with weights carried on either end thereof, comprising:

(a) a first frame assemblage including:

(i) a pair of spaced apart upstanding members, disposed within a substantially vertically extending plane and including support means for supporting the elongate bar; and (ii) a cross-member interconnecting said upstanding members at locations intermediate their ends;

(b) a second frame assemblage cooperatively associated with said first frame assemblage including:

(i) a rigid member extending transversely of said cross member;

(ii) a seat portion carried by said rigid member a substantial portion of said seat portion being disposed forwardly of the plane of said upstanding members and a substantial portion being disposed rearwardly thereof; and (iii) a back portion adapted for pivotal movement between first and second positions, said back portion being spaced apart from the plane of said upstanding members whereby, with the elongate bar supported on the support means, the trainee can sit on said seat portion facing the elongate bar and lean against said back portion with his upper body portion being positioned solely between the plane of said upstanding members and said back portion and with his lower body portion intersecting the plane of said upstanding members.

9. An exercise bench as defined in claim 8 in which said support means are vertically adjustable relative to said upstanding members.

10. An exercise bench as defined in claim 8 including:

(a) an angularly downwardly depending member connected to said rigid member; and (b) adjustment means cooperatively associated with said angularly downwardly depending member for supporting said back portion at a plurality of intermediate positions between said first and second positions.

11. An exercise bench as defined in claim 10 in which said adjustment means comprises an elongate member having one end adapted to engage said back portion and the other end adapted to engage said angularly downwardly depending member whereby the incline of said back portion can be varied.

12. An exercise bench for use by a trainee in the performance of exercises, including free weight exercises, using an elongate bar with weights carried on either end thereof, comprising:

(a) a first frame assemblage including:

(i) a pair of spaced apart upstanding members, disposed within a substantially vertically extending plane and including support means for supporting the elongate bar; and (ii) a cross-member interconnecting said upstanding members at locations intermediate their ends;

(b) a second frame assemblage cooperatively associated with said first frame assemblage including:

(i) a rigid member extending transversely of said cross-member;

(ii) a seat portion carried by said rigid member at least one-eighth of said seat portion being disposed forwardly of the plane of said upstanding members and a portion being disposed rearwardly thereof; and (iii) an angularly downwardly depending member connected to said rigid member;

(iv) a back portion pivotally connected to said rigid member, said back portion being rearwardly spaced apart from the plane of said upstanding members whereby, with the elongate bar supported on the support means, the trainee can sit on said seat portion facing the elongate bar and lean against said back portion with his upper torso being positioned between the elongate bar and said back portion and with the thigh-hip portions of his lower body being positioned between said upstanding members; and (v) adjustment means cooperatively associated with said angularly downwardly depending member for supporting said back portion at a plurality of intermediate positions between said first and second positions, said adjustment means comprising an elongate member having one end pivotally connected to said back portion and the other end adapted to be interconnected with said angularly downwardly depending member at a plurality of locations along its length.

* * * * *